US010392173B2

(12) United States Patent
Pucci et al.

(10) Patent No.: US 10,392,173 B2
(45) Date of Patent: Aug. 27, 2019

(54) SAFETY CAPSULE FOR CONTAINERS

(71) Applicant: SACMI COOPERATIVA MECCANICI IMOLA SOCIETA' COOPERATIVA, Imola (Bologna) (IT)

(72) Inventors: Fabrizio Pucci, Castel Guelfo di Bologna (IT); Enrico Gianfranco Campari, Bologna (IT); Giorgio Matteucci, Bologna (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 703 days.

(21) Appl. No.: 14/905,910

(22) PCT Filed: Aug. 29, 2014

(86) PCT No.: PCT/IB2014/064142
§ 371 (c)(1),
(2) Date: Jan. 18, 2016

(87) PCT Pub. No.: WO2015/028979
PCT Pub. Date: Mar. 5, 2015

(65) Prior Publication Data

US 2016/0159536 A1 Jun. 9, 2016

(30) Foreign Application Priority Data

Aug. 29, 2013 (IT) ..... MO2013A0242

(51) Int. Cl.
*B65D 55/00* (2006.01)
*B65D 55/02* (2006.01)
*B65D 41/04* (2006.01)

(52) U.S. Cl.
CPC ..... *B65D 55/026* (2013.01); *B65D 41/045* (2013.01); *B65D 55/022* (2013.01); *B65D 2101/0069* (2013.01)

(58) Field of Classification Search
CPC .. B65D 55/026; B65D 41/045; B65D 55/022; B65D 2101/0069
(Continued)

(56) References Cited

U.S. PATENT DOCUMENTS 2,939,597 A 6/1960 Greene
3,004,684 A * 10/1961 Lightburn ..... G03B 21/64 206/389
(Continued)

FOREIGN PATENT DOCUMENTS

DE 29600635 2/1997
EP 1413526 A1 4/2004
(Continued)

*Primary Examiner* — Ernesto A Grano
(74) *Attorney, Agent, or Firm* — Pearne & Gordon LLP

(57) ABSTRACT

A safety capsule for containers, comprising: an external cap (2), provided with coupling means for the coupling thereof to the neck (C) of a container; an internal element (3), located inside the external cap (2) and configured to be associated, in a removable manner, with an opening (A) of the container; connecting means (4, 5), interposed between the external cap (2) and the internal element (3), and structured so as to leave the external cap (2) and the internal element (3) unconstrained with respect to a movement for opening or removal of the external cap (2) between a closed position and an intermediate position, and solidly constrain the external cap (2) and the internal element (3) with respect to the movement for opening or removal of the external cap (2) between the intermediate position and an opening position; a signalling means (S) structured so as to take on a given configuration in the intermediate position.

15 Claims, 12 Drawing Sheets

(58) Field of Classification Search
USPC ..... 215/230
See application file for complete search history.

(56) References Cited

U.S. PATENT DOCUMENTS 4,475,661 A * 10/1984 Griffin ..... B65D 55/066 206/459.5
4,502,605 A * 3/1985 Wloszczyna ..... B65D 55/066 215/203
4,526,752 A * 7/1985 Perlman ..... B65D 55/026 116/207
4,793,500 A * 12/1988 Harding ..... B65D 55/066 116/307
4,801,011 A * 1/1989 Desdoigts ..... A45C 11/38 206/389
4,872,570 A * 10/1989 Harding ..... B65D 55/066 215/230
4,928,837 A * 5/1990 Curiel ..... B65D 43/0212 215/230
5,018,632 A * 5/1991 Schmidt ..... B65D 55/026 215/230
5,035,341 A * 7/1991 Heilman ..... B65D 55/066 215/230
5,092,477 A * 3/1992 Johnson, Jr. ..... B65D 55/066 215/220
5,265,744 A 11/1993 Duty et al.
5,289,929 A * 3/1994 Heilman ..... B65D 55/026 116/279
5,474,194 A * 12/1995 Heilman ..... B65D 55/066 215/230
5,497,879 A * 3/1996 Kao ..... B65D 43/0218 206/389
5,592,766 A * 1/1997 Mygatt ..... B65D 51/245 40/307
D389,062 S * 1/1998 Ekkert ..... D9/453
5,839,592 A * 11/1998 Hayes ..... B32B 27/08 215/230
5,882,116 A * 3/1999 Backus ..... B65D 27/30 206/807
5,884,788 A 3/1999 Wilde
5,896,686 A * 4/1999 Howes ..... G09F 19/14 206/459.1
6,065,623 A * 5/2000 Hierzer ..... B65D 51/245 215/230
6,226,907 B1 * 5/2001 Conley ..... G03B 25/02 359/619
6,394,293 B1 * 5/2002 Hierzer ..... B65D 51/245 206/459.5
6,450,355 B1 * 9/2002 Lowry ..... B65D 3/22 220/212
6,694,596 B2 * 2/2004 Hierzer ..... B65D 51/245 215/230
7,000,790 B1 2/2006 Bae
7,457,039 B2 * 11/2008 Raymond ..... B44F 1/10 359/619
D750,314 S * 2/2016 Hobson ..... D26/118
10,071,840 B2 * 9/2018 Roussy ..... B65D 51/245
10,195,890 B2 * 2/2019 Cote ..... B42D 25/342
2002/0079281 A1 * 6/2002 Hierzer ..... B65D 51/245 215/230
2002/0085287 A1 * 7/2002 Egawa ..... G02B 3/005 359/619
2006/0283749 A1 * 12/2006 Wolfe ..... B65D 75/36 206/462

FOREIGN PATENT DOCUMENTS

GB 2107290 A 4/1983
GB 2397294 A 7/2004

* cited by examiner

SAFETY CAPSULE FOR CONTAINERS

The object of the present invention is a capsule for containers that is provided with an indicator signalling that opening has taken place.

In particular, the invention refers to a capsule configured for application to the neck of a container.

Several types of capsules designed for application to the neck of a container are currently present on the market. Such capsules are largely used for closing bottles of water and soft drinks, milk containers, containers for fruit juices and other foods or liquid substances.

In addition to realizing a hermetically sealed closure immediately following the packaging of the product inside the container, and possibly also after the container has been opened for the first time, capsules of the type at hand must provide an immediate indication signalling that the first opening of the container has taken place. This is because the consumer must clearly be able to realize immediately the state of the container about to be purchased or opened for the first time. For obvious reasons concerning safety, upon the first opening, the container must be in an intact condition.

The capsules currently available perform the function of indicating the intactness thereof by means of various components.

The most widely used component is constituted by a ring-shaped element, also called an intactness or safety strip, which is associated with a lower edge of the capsule by means of a breakable connection. Upon the first opening of the capsule, the intactness strip remains connected to the neck of the container, but it detaches from the edge of the capsule. In addition to increasing the dimensions of the capsule in the axial direction, the use of an intactness strip does not, in any case, offer in particular high assurance of intactness. In fact, by carefully removing the capsule and slightly forcing the widening of the intactness strip, it is possible to have the strip slide off the neck of the container without causing its detachment from the capsule. Moreover, the presence of the safety strip makes the phase consisting of the first application of the capsule to the container relatively complex, besides increasing the weight and the cost of the capsule itself.

The use of small discs or films is provided for as an alternative to the intactness strip, and in a phase following the insertion of the product in the container, they are applied to the neck or to the opening of the container itself. Upon the first opening, after having removed the capsule, the consumer removes the small disc or film, which cannot be reapplied subsequently to the neck or the opening of the container. These components do not offer in particular high assurance of intactness either, as they can be easily perforated in a manner that is not visible. Moreover, it is often difficult for the user to remove them, and additionally they complicate the product packaging process.

Capsules are also proposed that are equipped with means for indicating that the first opening has taken place, by means of the appearance of a signal or writing visible on the outside the capsule. These capsules generally comprise an external cap designed to screw onto the neck of the container, and a small disc or another safety guarantee component, which, at least in a configuration preceding the first opening of the capsule, is removably constrained to the neck or the opening of the container. The external cap is provided with a window overlying the safety guarantee disc that bears in the upper part thereof a signal indicating that the first opening has taken place. Upon the first opening of the capsule, the external cap and the disc can rotate with respect to each other between an unaligned position, in which the signal indicating that the first opening has taken place is not visible from the outside, and an aligned position, in which the signal indicating that the first opening has taken place is visible from the outside through the window on the external cap. Besides being quite complex to realize, capsules of this type are not adequately irreversible. Essentially, once the first opening of the capsule has taken place, no means are provided that effectively prevent the external cap and the safety guarantee disc from being brought back into the position preceding the first opening.

The aim of the present invention is to offer a capsule that makes it possible to overcome the drawbacks of the known types of capsules.

One advantage of the capsule according to the present invention is that it enables immediate identification of the first opening of the container to which it is applied, without any need for a safety strip or other components.

Another advantage of the capsule according to the present invention is that it is easily activated by the user, by means of a simple opening rotation.

Another advantage of the capsule according to the present invention is that it is absolutely irreversible, that is, following the first opening, it cannot be brought back into a configuration preceding that of the completed first opening.

Further characteristics and advantages of the present invention will become more apparent from the following detailed description of an embodiment of the invention, which is illustrated by way of non-limiting example in the accompanying figures, in which.

Figure 1:
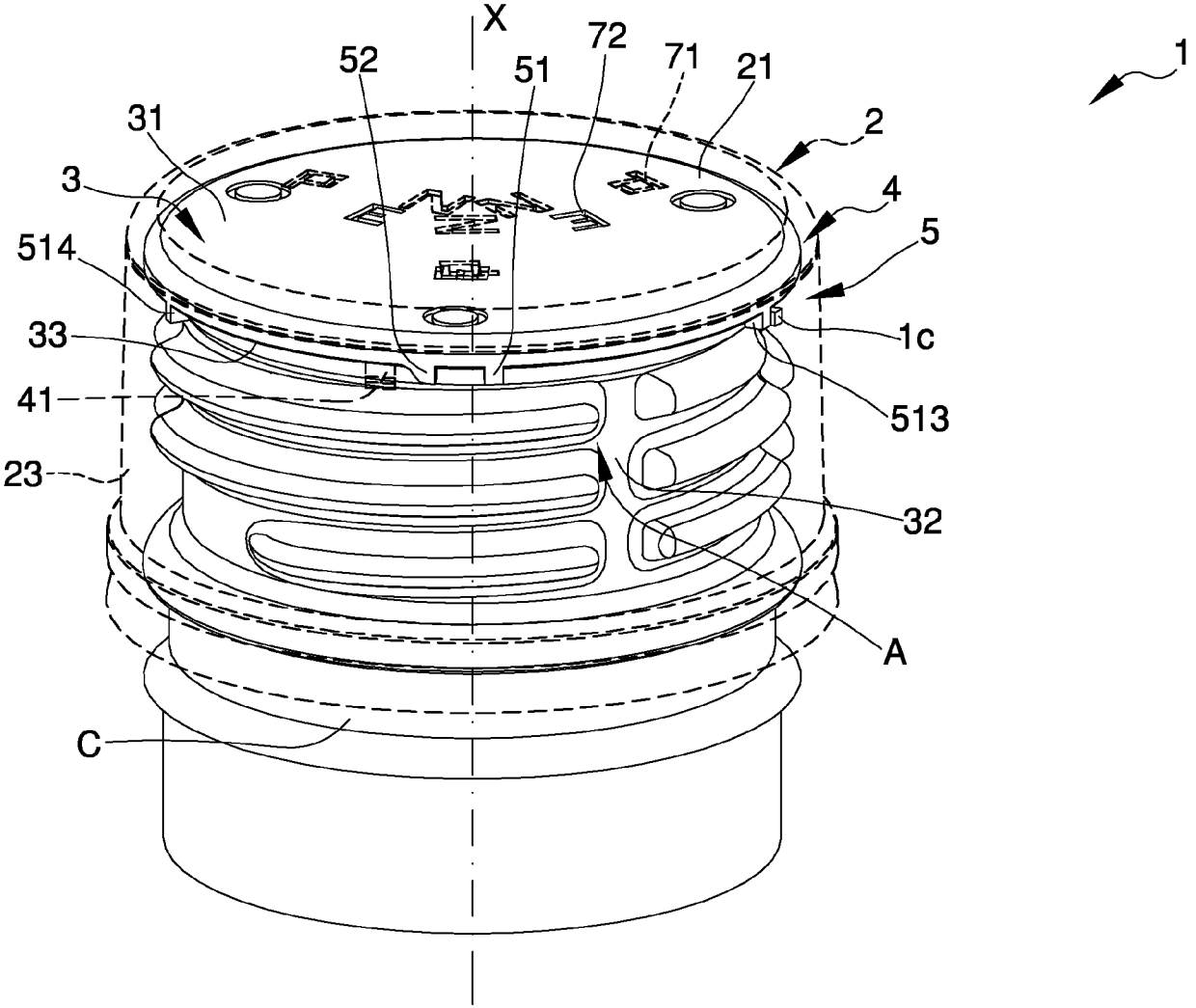
FIG. 1 shows a schematic view of a first embodiment of the capsule according to the present invention.

The safety capsule according to the present invention comprises an external cap (2), that is internally provided with means for the coupling thereof to the neck (C) of a container. The coupling between the external cap (2) and the neck (C) of the container can be realized in various manners, for example by means of threading, snap-on or bayonet couplings. Generally, three types of couplings are distinguishable: a first type that comprises at least one rotation movement of the external cap (2) with respect to the neck (C) about a longitudinal axis (X), a second type of coupling comprising at least one sliding movement of the external cap (2) along the longitudinal axis (X) and a third type of coupling comprising a rotation of the external cap (2) about an axis perpendicular to the longitudinal axis (X), that is, a hinged movement.

The external cap has an upper portion (21) that is preferably circular in shape, and from which a lateral portion (23) extends substantially concentric with the longitudinal axis (X). In the case in which a threaded coupling with the neck (C) is provided, the threading for coupling to the neck (C) of the container can be fashioned on an inner surface of the lateral portion (23).

The capsule further comprises an internal element (3) located inside the external cap (2) and that is configured to be associated, in a removable manner, with an opening (A) of the container. As shown in the figures, the internal element (3) may have the form of a disc, shaped in such a manner as to be insertable, at least partially, inside the opening (A), realizing therein an interference fit seal. In this embodiment, the safety guarantee element comprises an upper portion (31) that is substantially flat and circular in shape, below which a lower portion (32) is located. This lower portion (32) is intended for insertion in the opening (A), whereas the upper portion (31) is structured so as to enable placement in contact with the upper edge of the opening (A). The upper portion (31) is preferably of a larger diameter than the lower portion (32), so that a projecting edge (33) of a substantially annular shape and concentric with the longitudinal axis (X) is defined between said portions (31, 32). As an alternative to the external cap (2), the internal element (3) could be coupled to the neck of the container by means of a thread.

As can be seen in the figures, the internal element (3) is located below the upper portion (21) of the external cap (2), in proximity to or in contact with the upper portion (21). When the external cap (2) is applied on the neck (C) of the container in a position of complete closure, the lower portion (32) of the internal element (3) is inserted, as mentioned previously, in the opening (A). The internal element (3) can be firmly constrained to the external cap (2) with respect to direct movements along the longitudinal axis (X), or constrained with some clearance and with the possibility of performing limited movements along the longitudinal axis (X).

Connecting means (4, 5) are interposed between the external cap (2) and the internal element (3). The connecting means are structured so as to leave the external cap (2) and the internal element (3) unconstrained with respect to a movement for opening or removal of the external cap (2) between a closed position and an intermediate position, and to solidly constrain the external cap (2) and the internal element (3) with respect to the movement for opening or removal of the external cap (2) between the intermediate position and an opening position.

The connecting means (4,5), structured as described, make it possible to divide the opening of the capsule (1) into two phases: a first phase, from an initial position of complete closure to an intermediate position, during which the external cap (2) rotates relative to the internal element (3), and a subsequent phase, from the intermediate position on, during which the external cap (2) and the internal element (3) are jointly constrained at least with respect to rotation in the opening direction. The relative rotation and/or axial nearing between the external cap (2) and the internal element (3) that occurs during the initial opening phase can be utilized advantageously as an indication signalling that the first opening of the container has taken place.

With this aim, the capsule according to the present invention is provided with a signalling means (S), which is structured to take on a given configuration in the intermediate position. This configuration can be associated with an indication signalling that the first opening of the capsule has taken place.

For the realization of the signalling means (S), the external cap (2) can be provided with a transparent or semi-transparent top portion (21). For this purpose, the external cap (2), or at least the top portion (21) thereof, can be made of a translucent material, for example PP copolymer. The top and/or bottom part can be configured, entirely or partially, as a lens or a system of lenses, and possibly be polarized by means of the application of specific films, or the top part can be made locally transparent by varying the surface geometry and/or the roughness thereof in a specific zone. In other words, the top part can be rendered opaque or translucent by varying the surface geometry and/or roughness thereof.

For the realization of the signalling means (S), chemical components can be interposed between the external cap (2) and the internal element (3) and during the first opening of the capsule, coming into contact with each other, the components produce a reaction that forms a coloured substance that is visible from the exterior. A further possibility is offered by the utilization of birefringent materials, for example calcium carbonate ($CaCO_3$), in order to obtain the polarization of the top portion (21) of the external cap (2) and the internal element (3).

In a first embodiment of the capsule, at least a first signal (71), for example writing or a symbol, is integral with the external cap (2) and visible through the top part (21) thereof. At least a second signal (72), for example more writing or another symbol, is integral with the internal element (3) and visible through the top part (21) of the external cap (2). The first and the second signal are located so as to align with each other in the intermediate opening position.

Figure 2:
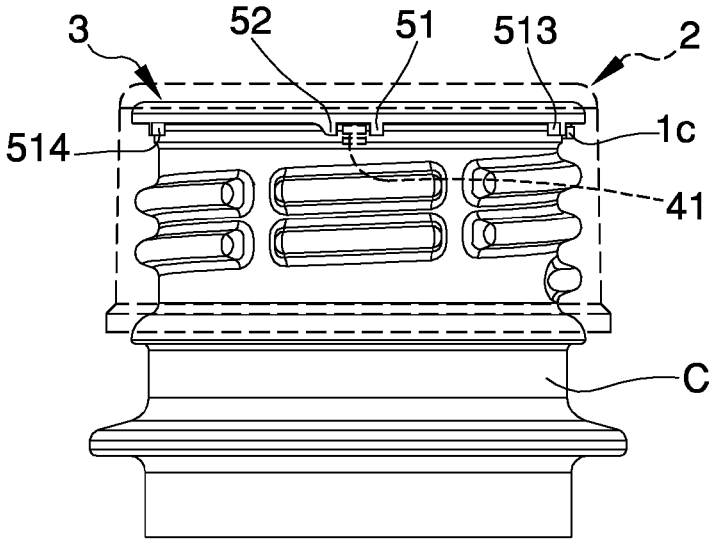
FIGS. 2 and 3 show further views of the embodiment of FIG. 1.
Figure 3:
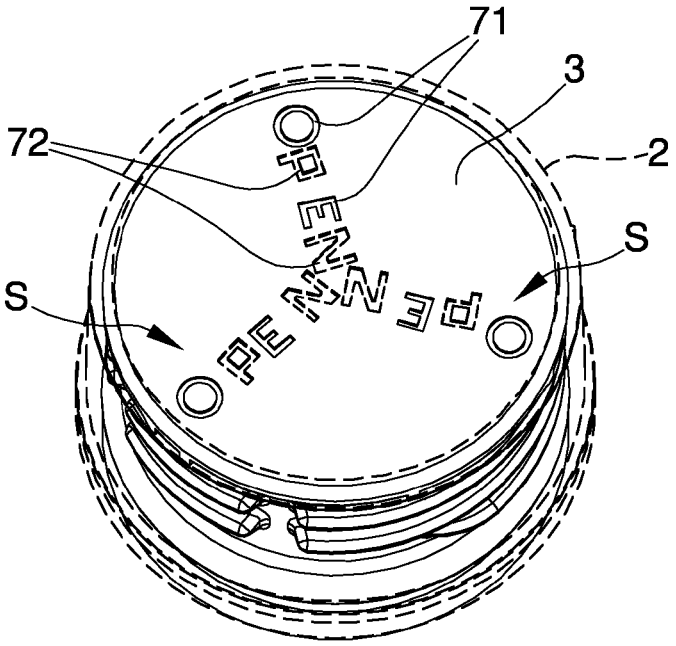
Figure 5:
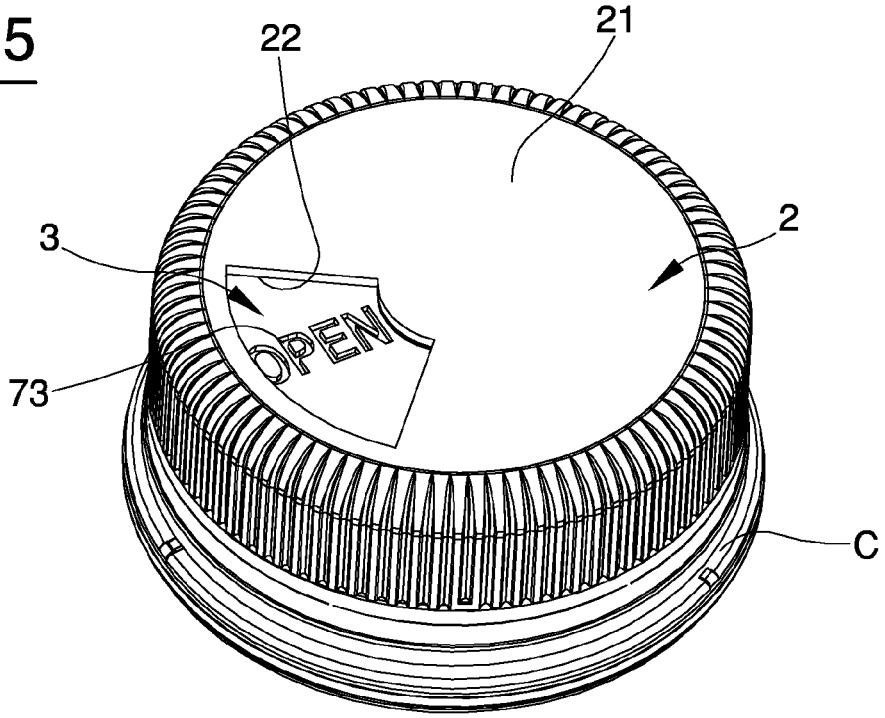

As illustrated schematically in FIGS. 1 to 3 and in FIG. 5, the first signal (71) is defined by a series of letters that are aligned, and the second signal (72) is defined by a series of other letters that are aligned. In the intermediate opening position, the various letters are aligned with each other so as to form a word, for example the word "aperto" or "open", or another word. In general, the alignment of the first and the second signal can be used as an indication signalling that the opening has taken place for the first time. As an alternative, only one of the signals (71, 72) may be present, and it could be integral with the external cap (2) or to the internal element (3), and be visible by means of a lens, or a combination of lenses, located on the top part (21) of the external cap (2), or it could be visible even through the top translucent portion depending on the axial distance between the internal element (3) and the top portion (21) itself.

Figure 4:
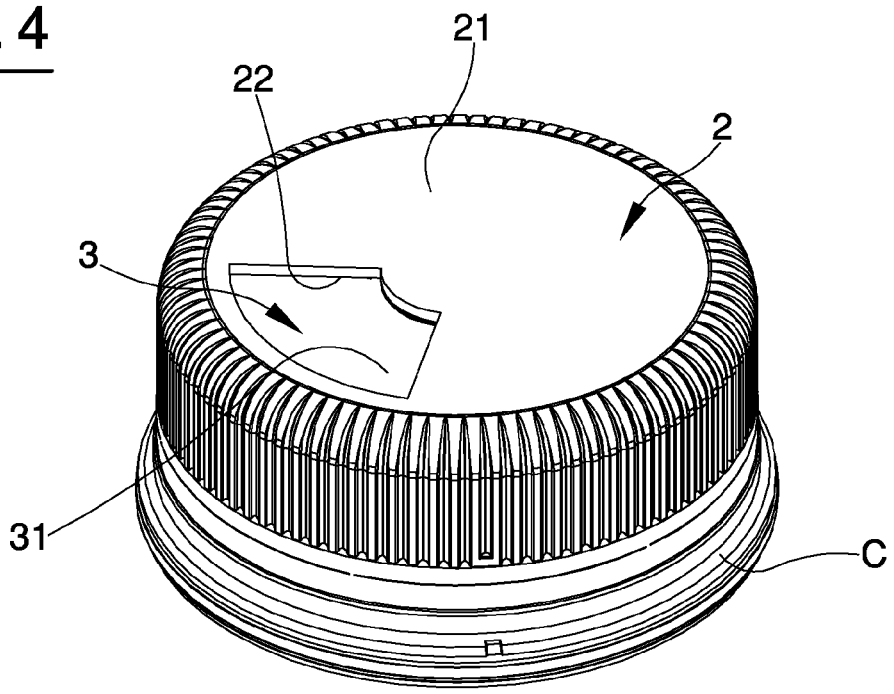
FIGS. 4 and 5 show two views of a further embodiment of the capsule.

In an alternative embodiment, illustrated in FIGS. 4 and 5, the signalling means comprises an upper window (22), fashioned on the external cap (2), that opens towards the internal element (3), or is at least transparent. A signal or symbol (73) is located on the top part (31) of the internal element (3). The window (22) and the symbol (73) are located so as to face each other in the intermediate position. In the intermediate opening positioning of the capsule, the symbol (73) is visible and centred in the window (22), whereas prior to reaching the intermediate unscrewing position, the symbol (73) is not visible, or is only partially visible. In a wholly equivalent manner, the symbol (73) could be visible in the closed position and not be visible in the intermediate position, so that the indication that the first opening has taken place is determined by the non-visibility of the symbol (73).

In a wholly equivalent manner, the top part (21) of the external cap (2) could be transparent, and the window (22) could be replaced by an opaque portion, disposed in such a way as to cover a signal in the closed position and uncover that signal in the intermediate position, in order to indicate that the first opening has taken place. Naturally, the opaque portion could be of any shape or size.

Figure 6:
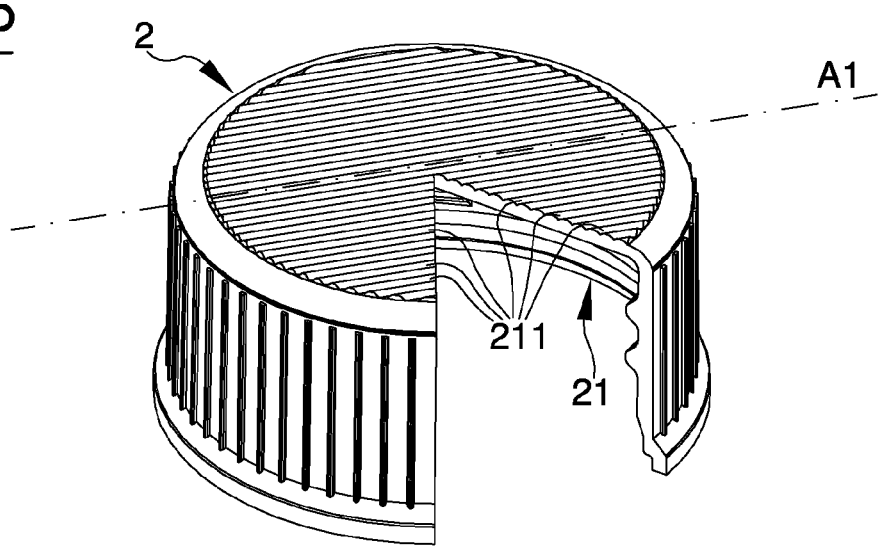
FIGS. 6 to 10 show views and components of a further embodiment of the capsule.
Figure 9:
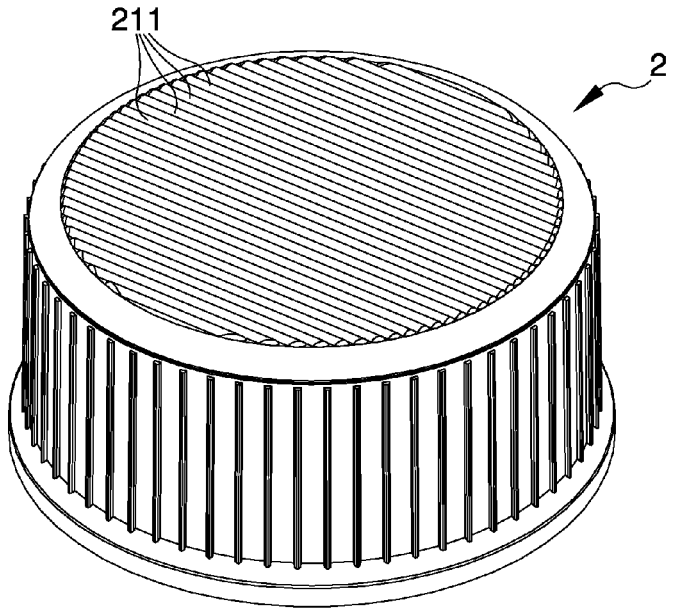
Figure 10:
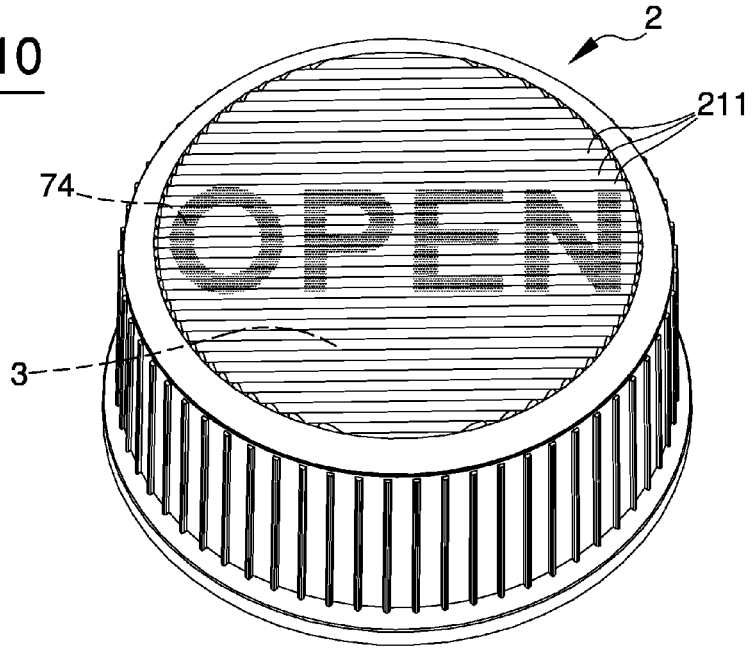
Figure 10A:
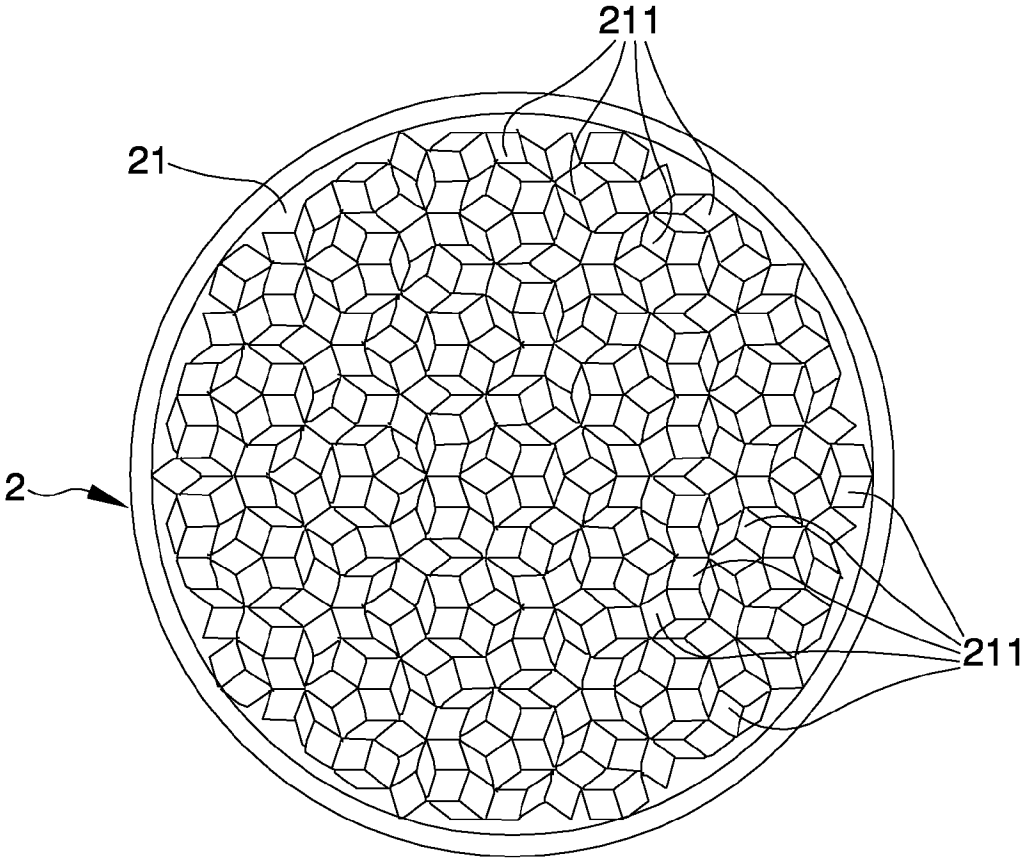
Figure 11:
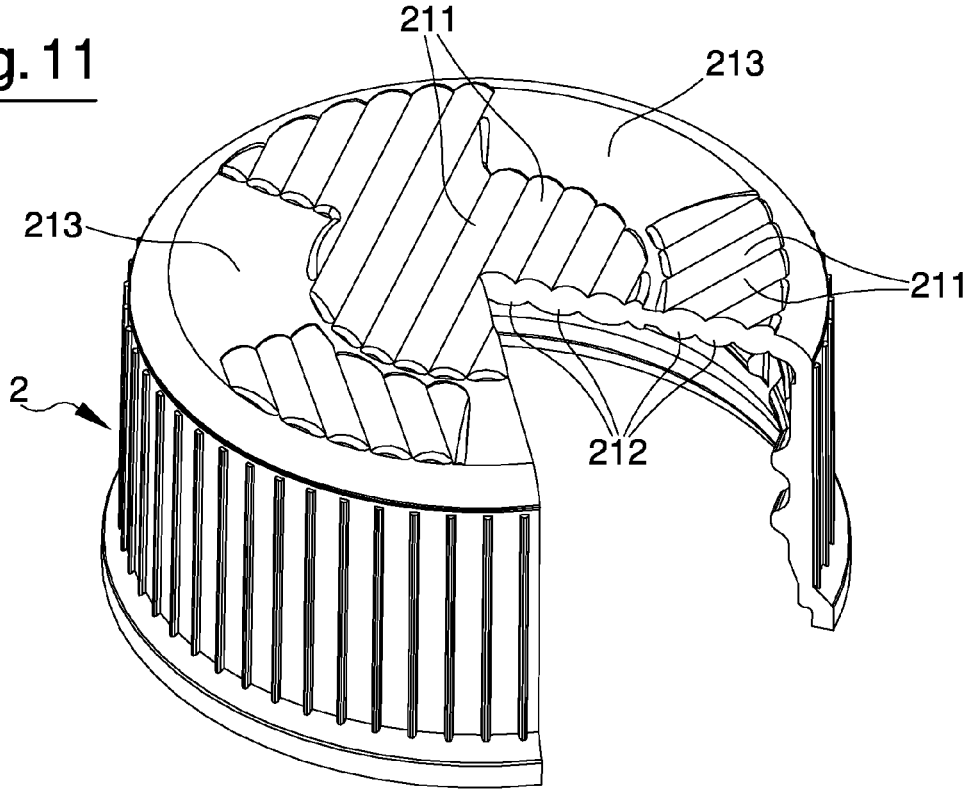
FIGS. 11 to 14 show views and components of a further embodiment of the capsule.
Figure 12:
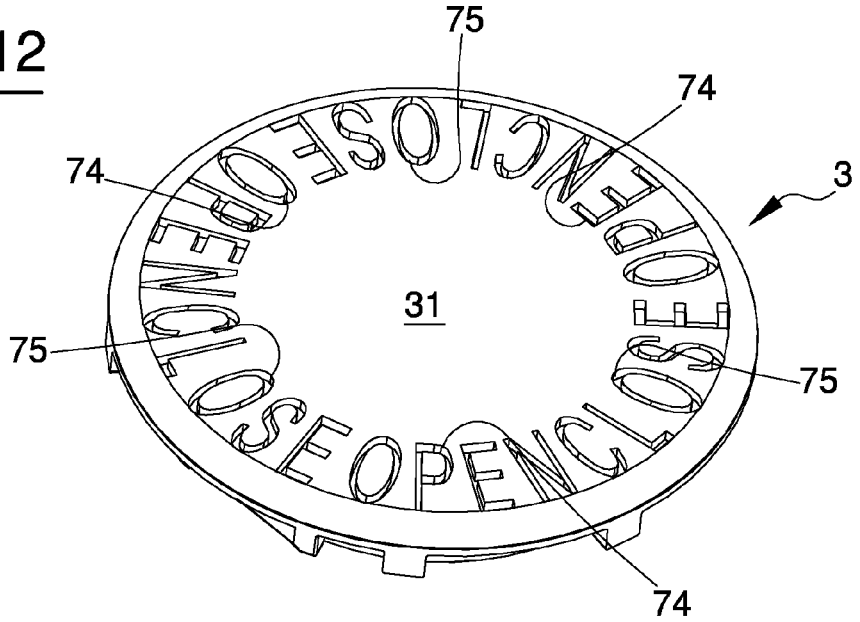
Figure 14:
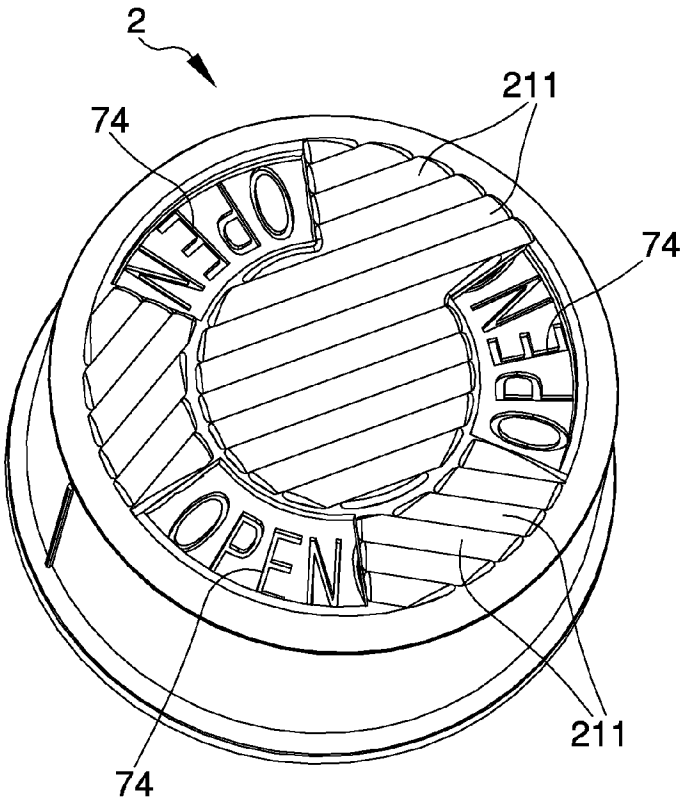
Figure 13:
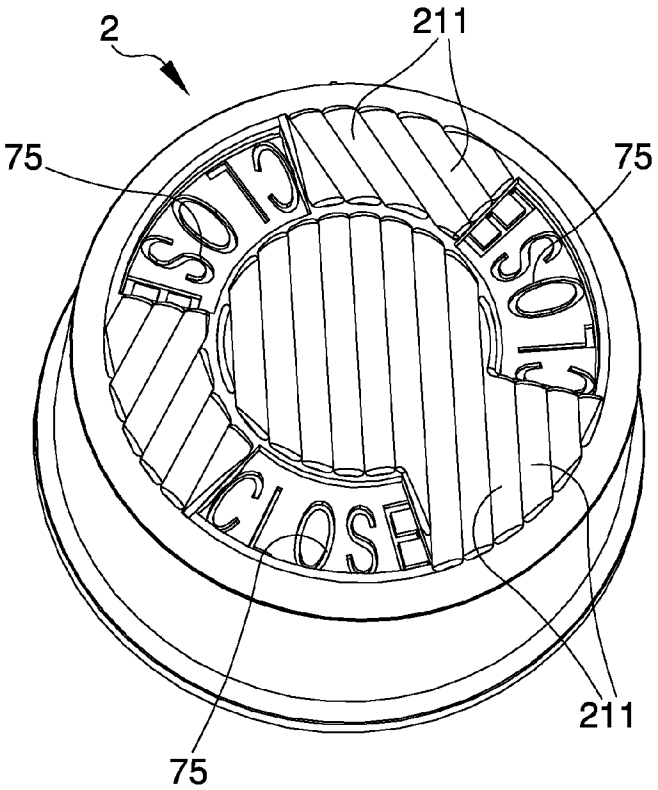

In a further embodiment, illustrated in FIGS. 6, 9 and 10, the top part (21) of the external cap (2) is transparent or semi-transparent and comprises a plurality of lenses (211) of prismatic shape. The lenses (211) can be located parallel to a main direction (A1). In unillustrated alternative embodiments, the lenses (211) can be distributed according to geometric schemes located in various ways, in order to focus and show, or hide, a given signal in a desired angular position of the external cap (2). An example of how the lenses (211) can be distributed is schematically shown in FIG. 10*a*. It is clear that the lenses (211) can substantially be distributed according to an infinite number of geometric schemes, among which the person skilled in the art can identify the one best suited to the purpose.

As shown in FIG. 6, the lenses (211) preferably project from an upper face of the top part (21). The lenses (211) preferably have a convex upper surface. Essentially, each lens (211) is of a preferred cylindrical conformation with a constant or variable curvature, aligned parallel to the main direction (A1).

Figure 7:
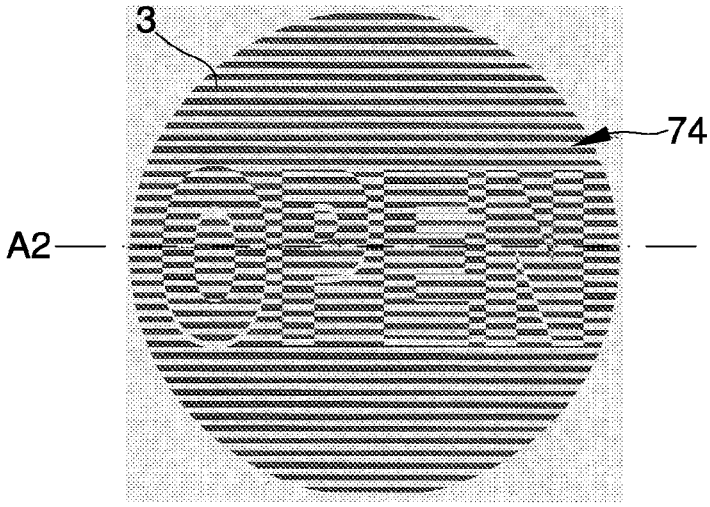

In this embodiment, the signalling means (S) comprises a first signal (74) that is located on an upper portion (31) of the internal element (3) and is in the form of parallel rectilinear segments parallel to a second direction (A2). As shown in FIG. 7, the first signal (74), for example writing or a symbol of any type, is made up of a plurality of segments or stripes parallel to one another. When the lenses (211) are located parallel to the segments or stripes that define the first signal (74), the first signal (74) can be seen and read through the lenses (211). For this purpose, the external cap (2) and the internal element (3) are located in an angular position relative to one another, so that the main direction (A1) and the second direction (A2) are parallel to each other in the intermediate opening position. In other words, in the rotation portion of the external cap (2), which goes from the closed position to the intermediate position, the directions (A1,A2) are not parallel to each other and the signal (74) is not visible and/or not legible. In the intermediate opening position the directions (A1,A2) are parallel to each other and the signal (74) is visible, indicating that the first opening of the capsule has taken place. Alternatively, the directions (A1,A2) could be parallel in the closed position of the capsule, to show a signal indicating, precisely, the closed position of the capsule, so that when the cap is rotated from the closed position to the intermediate position, the signal disappears from sight.

Figure 8:
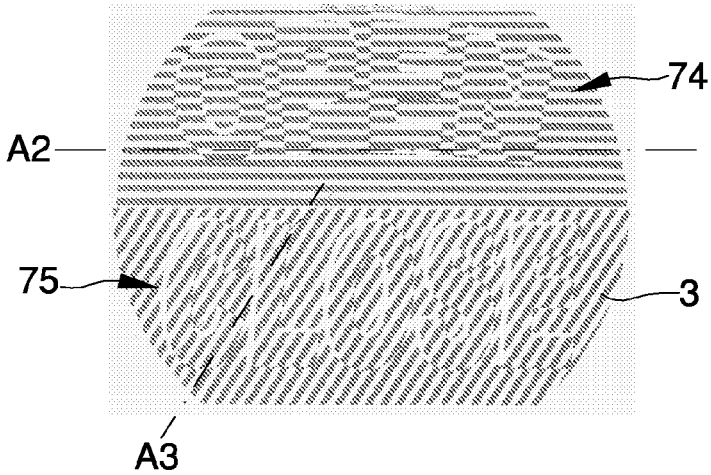

In a further embodiment, shown in FIG. 8, the signalling means (S) comprises a second signal (75) that is located on the upper portion (31) of the internal element (3) and is in the form of rectilinear segments parallel to a third direction (A3) that is inclined relative to a second direction (A2). The second and the third direction (A2, A3) are inclined relative to each other in such a way that, in the closed position, the third direction (A3) is parallel to the main direction (A1), so as to show the second signal (75), and the second direction (A2) is parallel to the main direction (A1) in the intermediate opening position, to show the first signal (74).

In a further embodiment, shown in FIGS. 11 to 14, the top part (21) of the external cap (2) comprises a first plurality of lenses (211), of prismatic shape, located parallel to the main direction (A1), and a second plurality of lenses (212), of prismatic shape, located parallel to an auxiliary direction (A4), which is inclined relative to the main direction (A1).

The first plurality of lenses (211) is located on one side of the top part (21), and the second plurality of lenses (212) is located on the opposite side of the top part (21). The different inclination of the main direction (A1) relative to the auxiliary direction (A4) renders the top part (21) of the cap (2) opaque.

The top part (21) comprises at least a transparent portion (213) which is not occupied by the lenses (211,212). The signalling means (S) comprises a signal (74) located on an upper portion (31) of the internal element (3). The transparent portion (213) and the signal (74) are located so as to face each other in the intermediate opening position. The transparent portion (213) substantially defines a window through which it is possible to see the signal (74).

In a further unillustrated embodiment, the top part (21) of the external cap (2) comprises a lens conformed so as to bring an upper portion (31) of the internal element (3) into focus in the intermediate opening position. In other words, the lens is conformed in such a way as to bring the upper portion (31) of the internal element (3) into focus when the internal element (3) is at a given distance from the lens itself. This distance is modified as a result of the axial shifting between the external cap (2) and the internal element (3) during opening of the capsule. The lens is conformed in such a way as to bring the upper portion (31) of the internal element (3) into focus when the internal element (3) is at the distance corresponding to the intermediate opening position of the capsule.

In the embodiments shown in FIGS. 1 to 14, the external cap (2) is coupled to the neck (C) by a coupling means (4,5) that provides for at least one initial rotation for the opening or the removal of the external cap itself, for example a threading or a cam or bayonet coupling, a rotation that also entails an axial movement. Considering an initial condition in which the capsule is applied on the neck of the container in a position of complete closure, with the internal element (3) associated with the opening (A) of the container, the connecting means (4, 5) are structured so as to enable one opening rotation of the external cap (2) with respect to the internal element (3), up to a given intermediate position. Essentially, during this rotation, the internal element (3) remains stationary, in that it is associated with the neck (C), whereas the external cap unscrews partially from the neck (C) of the container, while also shifting axially. In the intermediate position, the connecting elements (4, 5) intervene, thereby solidly constraining the external cap (2) and the internal element (3) at least with respect to the opening rotation. The connecting means (4, 5) are also structured so as to solidly constrain the external cap (2) and the internal element (3) with respect to the axial movement, at least in the direction of lifting the capsule from the neck (C) starting from a given position of the external cap (2).

The connecting means (4, 5) comprise at least a first connecting element (4), integral with the external cap (2), and at least a second connecting element (5), integral with the internal element (3).

In a first embodiment of the connecting means, the first connecting element (4) comprises a small tooth (41) which projects from an inner surface of the external cap (2) and faces the internal element (3). As can be seen in FIGS. 1 and 2, the small tooth (41) projects radially from the inner surface of the external cap (2), in particular of the lateral portion (23). The external cap (2) can be provided with more teeth (41), evenly distributed along a circumference concentric with the longitudinal axis (X), on a plane perpendicular to the longitudinal axis (X) itself.

In addition to interacting with the second connecting element (5), the first tooth (41) is also structured so as to retain the internal element (3) inside the external cap (2), with or without a given axial clearance. The tooth (41)

projects beneath the projecting edge (33) of the internal element (3), so as to prevent the internal element from sliding off the external cap (2). When the external cap (2) is removed from the neck (C) of the container, the retention performed by the first small tooth (41) also enables the internal element (3) to be removed with the external cap (2) itself. Moreover, the small tooth (41) serves to lift the internal element (3) during the opening rotation of the external cap (2).

The second connecting element (5) comprises a first small tooth (51) that projects from an external surface of the internal element (3) and faces the external cap (2). Preferably, the first small tooth (51) is associated with the projecting edge (33) of the internal element (3), projecting downwards.

As can be seen in FIGS. 1 and 2, the small tooth (41) of the external cap (2) and the first small tooth (51) of the internal element (3) are located at a distance from the longitudinal axis (X), the distance being such as to enable contact between them in the intermediate opening position. Starting from an initial condition in which the capsule (1) is completely screwed onto the neck (C) in the closed position, in the course of the opening rotation of the external cap (2), the small tooth (41) of the external cap (2) comes into contact with the first small tooth (51) of the internal element (3) in the intermediate opening position. Continuing the opening rotation from the intermediate position, the external cap (2) drags the internal element (3) into rotation, by virtue of the contact between its own small tooth (41) and the first small tooth (51) of the internal element (3).

When the capsule is applied to the container for the first time, that is, during the closing rotation of the external cap (2), the internal element (3) and the external cap (2) rotate integral with the neck (C). During the closing rotation, at a certain point the internal element (3) comes into contact with the neck (C), so that friction is produced therebetween, which tends to block the rotation of the internal element (3). However, the external cap (2) is able to continue rotating at least until reaching a position in which the small tooth (41) of the external cap (2) comes into contact with the first small tooth (51) or with a possible additional abutment tooth (514) integral with the internal element (3), so that a given angular displacement is produced between it and the internal element (3).

In an unillustrated alternative embodiment, the small tooth (41) of the external cap (2) may comprise an end section of the thread located internally of the external cap (2) itself for coupling to the neck (C) of the container.

Advantageously, the second connecting element (5) comprises a second small tooth (52), alongside the first small tooth (51) in such a manner as to define a shaped space for receiving the first connecting element (4) in the intermediate opening position. The second small tooth (52) is preferably associated with the projecting edge (33) of the internal element (3), projecting downwards. The second small tooth (52) is located upstream of the first small tooth (51) with respect to the opening rotation of the external cap (2). The second small tooth (52) preferably has an external side, facing the opposite side that of the first small tooth (51) and shaped so as to facilitate passage over the small tooth (41) of the external cap (2) during the opening rotation of the external cap (2). As shown in FIGS. 1 and 2, the external side of the second small tooth (52) is radiused or inclined in a ramp-like fashion from the base towards the top of the second tooth (52) itself. During the opening rotation of the external cap (2), the small tooth (41) of the external cap (2) encounters the second small tooth (52) and slides over it, partially bending and/or causing partial bending of the second small tooth (52) as well, until it passes over the latter and positions itself in the space defined between the first tooth (51) and the second tooth (52), in the intermediate opening position. In this position, the external cap (2) and the internal element (3) are integral with each other with respect to the rotation about the longitudinal axis (X) in both directions. In fact, the second small tooth (52) is structured so as to prevent passage over the small tooth (41), with respect to a rotation in the closing direction. Upon reaching the intermediate opening position, that is, as soon as the small tooth (41) of the external cap (2) has passed over the second small tooth (52) and is located between the latter and the first small tooth (51), a short click is produced which is perfectly perceptible by the user and indicates that the first opening of the capsule (1) has taken place.

The shape and number of the various small teeth (41,51, 52) could vary to facilitate reciprocal interaction. Additional small teeth or appendages could also be present to supplement the functions performed by the small teeth (41,51,52) described.

Figure 15:
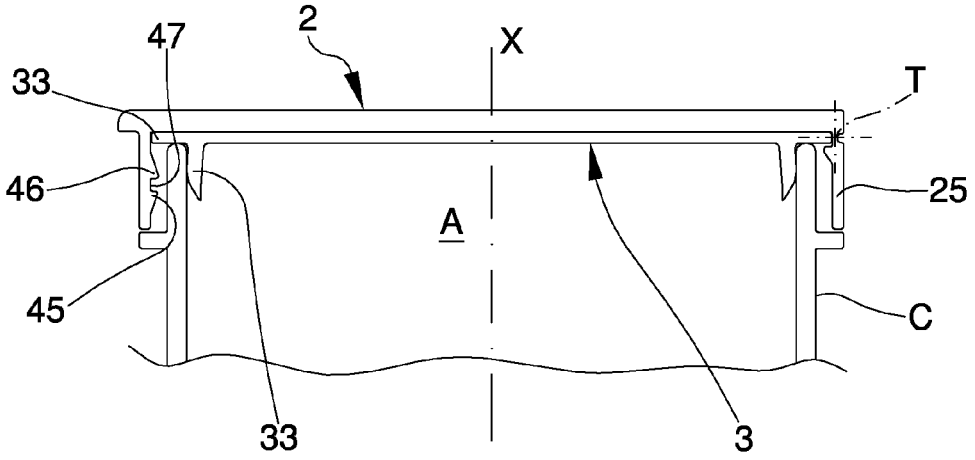
FIGS. 15 and 16 show an alternative embodiment of the capsule, in the part intended to be coupled to the neck of a container.
Figure 16:
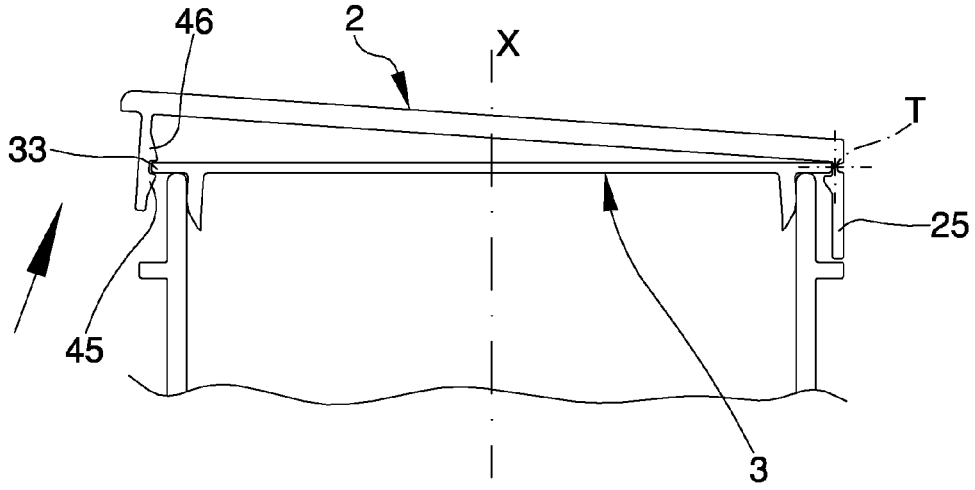
Figure 17:
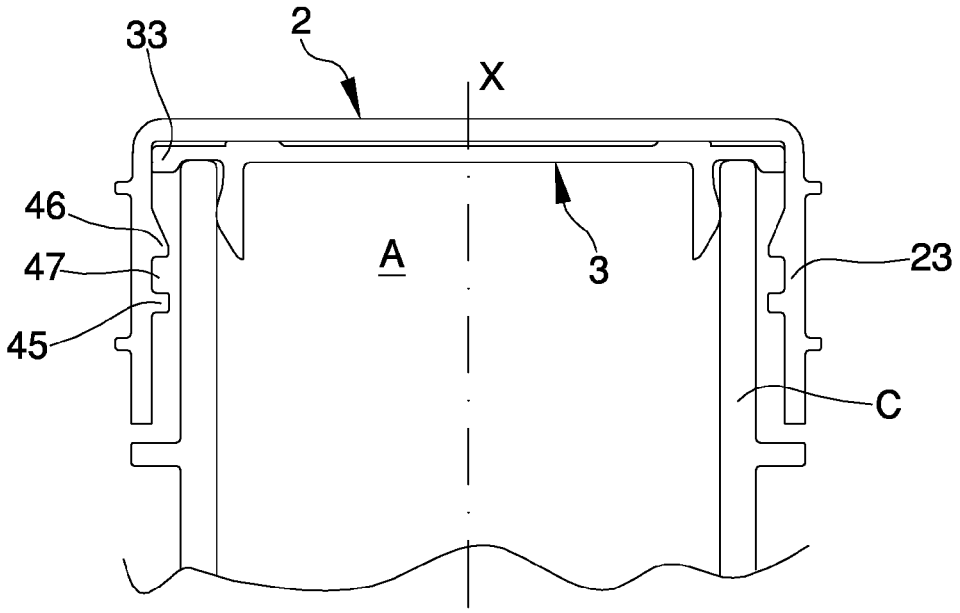
FIGS. 17 and 18 show a further alternative embodiment of the capsule, in the portion intended to be coupled to the neck of a container.
Figure 18:
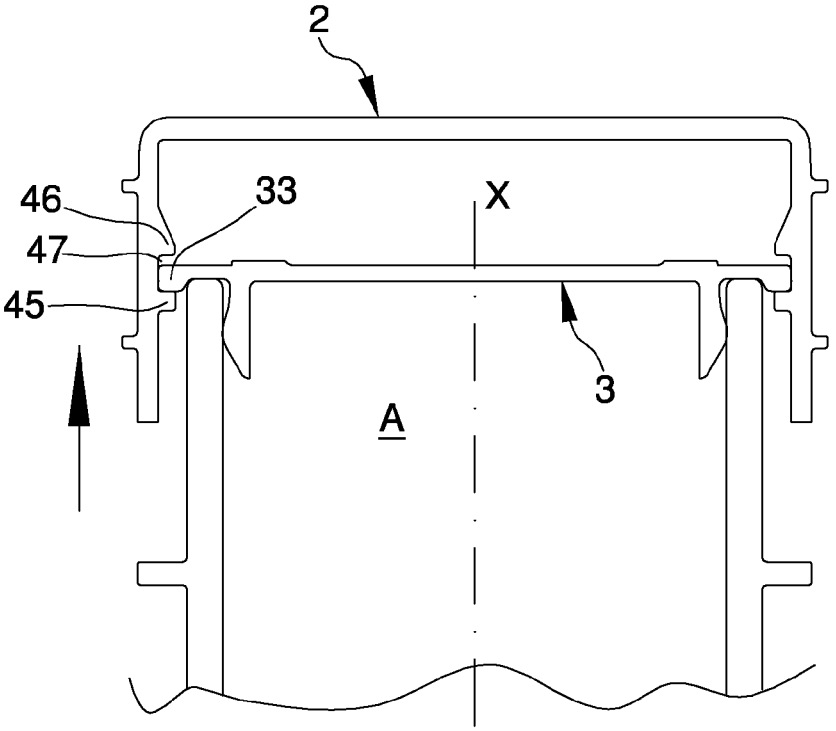

In the embodiments of FIGS. 15 to 18, the external cap (2) is coupled to the neck (C) by means of a coupling means that provides at least for a sliding movement of the external cap (2) along the longitudinal axis (X). The relative movement between the external cap and the neck (C) may consist solely of sliding along the longitudinal axis (X), as shown in FIGS. 17 and 18, or it may include rotation movement of the external cap (2) with respect to the neck (C) about a rotation axis perpendicular to the longitudinal axis (X), located at one edge zone of the neck (C), as shown in FIGS. 15 and 16, in which the external cap (2) rotates in hinged rotation with respect to the neck (C).

Considering an initial condition in which the capsule is applied on the neck of the container in a completely closed position, with the internal element (3) associated with the opening (A) of the container, the connecting means (4, 5) are structured so as to enable an opening, upward sliding of the external cap (2) with respect to the internal element (3), up to a given intermediate position. Essentially, during this movement, the internal element (3) remains stationary, in that it is associated with the neck (C), whereas the external cap (2) is partially lifted from the neck (C) of the container. In the intermediate position, the connecting elements (4, 5) intervene, thereby solidly constraining the external cap (2) and the internal element (3) at least with respect to the opening sliding movement along the longitudinal axis (X).

In this embodiment, the first connecting element (4) comprises at least a first bead (45) projecting inward from the lateral portion (23) of the external cap (2). The second connecting element (5) comprises a projecting edge (33), integral with the internal element (3) and structured so as to be located in contact with the first connecting element (4), that is, the first bead (45), in the intermediate position for opening or removal of the external cap (2). In the intermediate opening position, the projecting edge (33) of the internal element (3) is located in contact with the first bead (45). From this position, continuing in the movement for opening the external cap (2), that is, continuing the shifting of the external cap (2) along the longitudinal axis (X), the external cap (2) drags the internal element (3) along with it, removing it from the opening (A) of the neck (C), by virtue of the interference between the projecting edge (33) and the first bead (45). The first bead (45) and the projecting edge (33) preferably extend concentrically with the longitudinal axis (X) throughout the entire circumference. Alternatively, the first bead (45) and the projecting edge (33) may not extend throughout the entire circumference, but consist of successive tracts separated by predetermined angular pitches.

The first connecting element can be provided with a second bead (46) that projects inward from a lateral portion (23) of the external cap (2). This second bead (46) is alongside the first bead (45) so as to define a seat (47) comprised between the two beads (45, 46). The second bead (46) is located above the first bead (45). In addition, the second bead (46) is shaped so as to facilitate passage over the projecting edge (33) during the opening movement of the external cap (X). Essentially, during the opening movement of the external cap (2), the second bead (46) comes into contact with the projecting edge (33) before the external cap (2) reaches the intermediate opening position. Then the second bead (46) passes over the projecting edge (33), which is located in the intermediate position in contact with the first bead (45). During the process of passing over the projecting edge (33), the bead (46) produces a click that is clearly perceptible by the user. The second bead (46) is also shaped so as to prevent passage over of the projecting edge (33) in the opposite direction. In this manner, it is not possible to bring the internal element (3) back to the initial configuration preceding the opening of the capsule, that is, it is not possible to extract the projecting edge (33) from the seat (47) defined between the two beads (45, 46). Preferably, the second bead (46) extends concentrically with the longitudinal axis (X) throughout the entire circumference. Alternatively, the second bead (46) may not extend throughout the entire circumference, but consist of successive tracts separated by predetermined angular pitches.

The embodiment of the connecting means comprising at least the first bead (45) and the projecting edge (33) can be advantageously utilized for the realization of a safety capsule in which the external cap (2) can rotate with respect to the neck (C) about a rotation axis (T) perpendicular to the longitudinal axis (X), in an edge zone of the neck (C), in hinged rotation.

The axis of hinged rotation (T) can be substantially defined by a zone of contact between the external cap (2) and the internal element (3), which is located in an edge zone of the internal element (3). In this case, the external cap (2) can be removed by pushing on an opposite edge zone of the external cap (2), which tends to rotate with respect to the internal element (3) about the rotation axis (T).

In an alternative embodiment, the external cap (2) can be hinged to a collar configured to be associated with the neck (C) of the container. In this case, the rotation axis (T) is defined in the junction zone between the external cap (2) and the collar, which can also function as a guarantee or intactness strip.

The embodiment of the connecting means comprising at least the first bead (45) and the projecting edge (33) can be advantageously utilized in combination with the coupling means with axial rotation between the external cap (2) and the neck (C) of the container. Essentially, the relative axial motion between the external cap (2) and the internal element (3) can also be obtained through relative rotation between the external cap (2) and the neck (C) of the container, for example in the presence of a threaded or cam coupling as described hereinabove.

Figure 19:
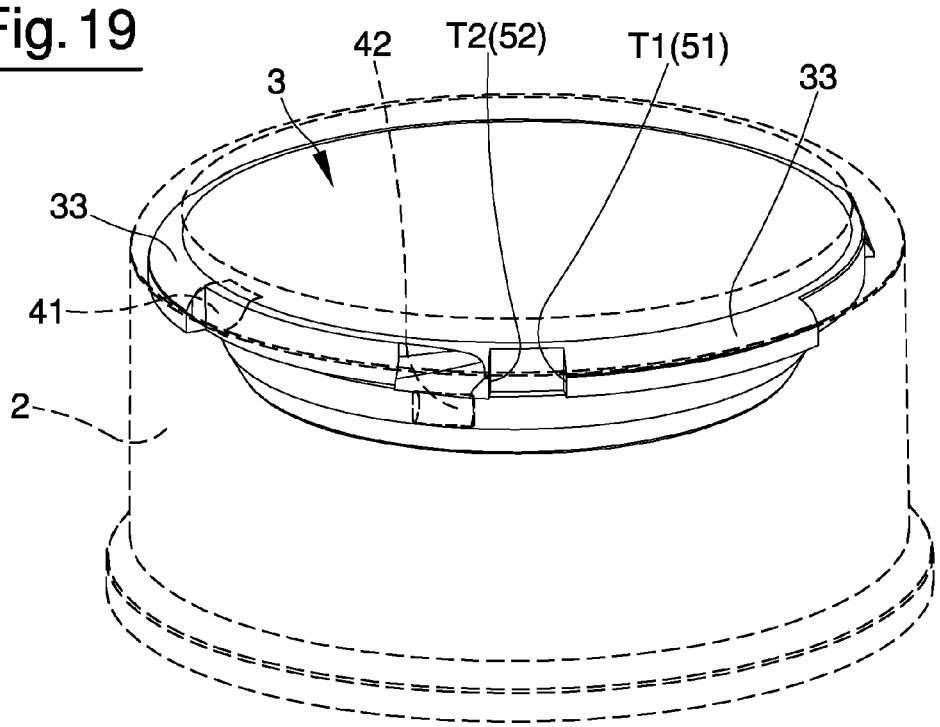
FIGS. 19, 20 and 21 show a further alternative embodiment of the capsule, in the part intended to be coupled to the neck of a container.
Figure 20:
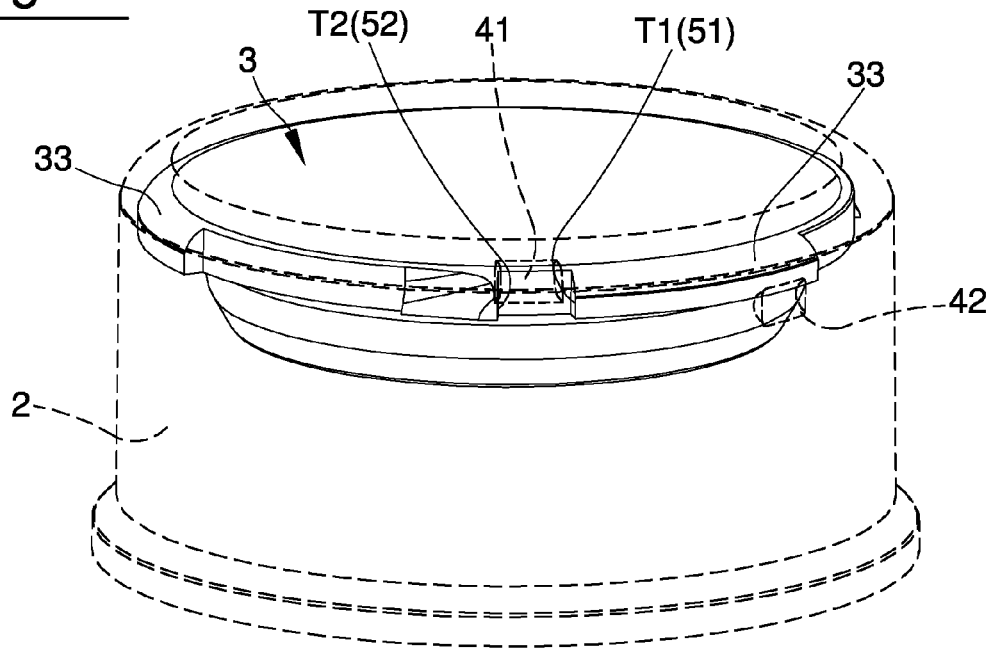
Figure 21:
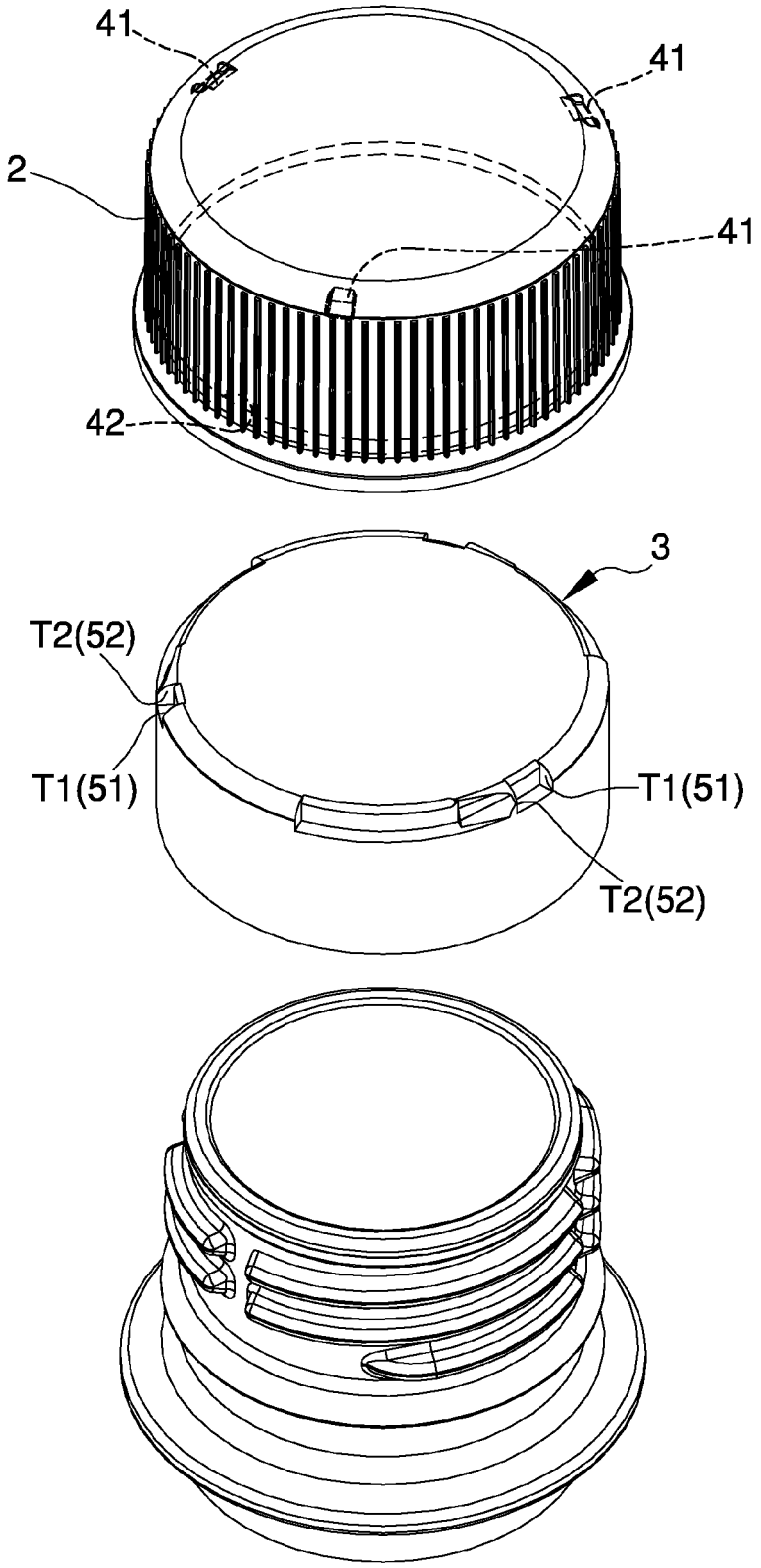

In a further embodiment, shown in FIGS. 19,20,21, the internal element (3) comprises a projecting edge (33) endowed with at least a transverse surface (T1) that defines the first small tooth (51). The transverse surface (T1) is disposed with a substantially radial orientation, so as to intercept the trajectory followed by the small tooth (41) of the external cap (2) during the opening rotation. At the moment in which the small tooth (41) is placed in contact with the transverse surface (T1), the intermediate opening position is defined, as in the other described embodiments.

The projecting edge (33) is preferably endowed with at least a second transverse surface (T2), which is facing the first transverse surface (T1) and defines the second tooth (52). The portion of the projecting edge (33) that projects from the second transverse surface (T2) away from the first transverse surface (T1) is preferably shaped like a decreasing ramp, that is, it has a radial extension that decreases with increasing distance from the first transverse surface (T1). This conformation facilitates passage by the small tooth (41) over the second transverse surface (T2), since, during rotation of the external cap (2) in the opening direction, the small tooth (41) encounters the projecting edge (33) in the zone of least radial extension. As it slides over the projecting edge (33), the small tooth (41) is thus guided outward until passing over the second transverse surface (T2) and being disposed between the latter and the first transverse surface (T1). Like the second small tooth (52) of the other embodiments, the second transverse surface (T2) prevents the small tooth (41) of the external cap (2) from being able to return into a position preceding the intermediate opening position.

In the embodiment of FIGS. 19 and 20 the external cap (2) is preferably provided with a connecting element (42) that projects from an inner surface of the external cap (2) and faces the internal element (3). The connecting element (42) could comprise or consist of a portion of the internal thread of the external cap (2). The connecting element (42) is structured so as to come into contact with the projecting edge (33) in such a way as to retain the internal element (3) inside the external cap (2), with or without clearance. In this manner, the internal element (3) remains integral with the external cap (2) with respect to axial translation and can be removed jointly with the external cap (2).

In the embodiment of FIG. 21 the internal element (3) is coupled to the neck (C) of the container by means of a thread. From the closed position to the intermediate position, during the opening rotation, the external cap (2) rotates freely relative to the internal element (3). From the intermediate position, the external cap (2) becomes integral with the internal element (3), which can thus be unscrewed by means of the external cap (2). Even if not visible, the solution of FIG. 21 comprises a connection element that is wholly analogous to the connection element (42) of the solutions shown in FIGS. 20 and 21.

The capsule according to the present invention provides important advantages. First and foremost, it offers a clear and efficient indication of the first opening of the container to which it is applied, without any need for additional elements. The rotation and/or relative axial movement between the external cap and the internal element that takes place in the first phase of the opening rotation, until the intermediate position is reached, can be effectively used for the realization of signalling means that can be easily seen by the user. The connecting means can also be structured so as to block therebetween, in a substantially irreversible manner, the external cap and the internal element in the intermediate unscrewing position, so that it is not possible to alter the signal indicating that the first opening has taken place. Moreover, the capsule is simple in construction, without requiring increases in cost compared to the capsules currently available, and even proves to be more economical than several models of capsules among those currently available.

The invention claimed is:

1. A safety capsule for containers, comprising: an external cap; an internal element, located inside the external cap and configured to be associated, in a removable manner, with an opening of a container; a coupling means configured to couple the external cap or the internal element to the neck of the container; connecting means, interposed between the external cap and the internal element, wherein the external cap is configured to rotate freely relative to the internal element with respect to a rotation of the external cap between a closed position and an intermediate position, and the external cap is configured to be jointly constrained to the internal element with respect to the rotation of the external cap between the intermediate position and an opening position;

a signalling means, structured to take on a given configuration in the intermediate position; wherein the external cap has at least a top part that is transparent and/or the conformation of which consists of a polarized or non-polarized lens or set of lenses.

2. The capsule according to claim 1, wherein: the signalling means (S) comprises at least a first signal (71), which is integral with the external cap (2) and visible through the top part (21) thereof, and at least a second signal (72), which is integral with the internal element (3) and visible through the top part (21) of the external cap (2); the first and the second signal are located so as to align with each other in the intermediate position.

3. The capsule according to claim 1, wherein the signalling means comprises: an upper window (22), fashioned on the external cap (2) and that opens towards the internal element (3), or is transparent, and a signal or symbol (73), integral with the upper part of the internal element (3); the window (22) and the symbol (73) are located so as to face each other in the intermediate position.

4. The capsule according to claim 1, wherein the internal element (3) comprises a top portion (31) that is at least partly transparent and/or the conformation of which consists of a polarized or non-polarized lens or set of lenses.

5. The capsule according to claim 1, wherein the top part of the external cap comprises a plurality of lenses of prismatic shape.

6. The capsule according to claim 5, wherein the lenses are located parallel to a main direction.

7. The capsule according to claim 5, wherein the lenses are distributed according to orderly or disorderly geometric schemes.

8. The capsule according to claim 5, wherein the lenses have a convex upper surface.

9. The capsule according to claim 5, wherein the signalling means comprise a first signal that is located on an upper portion of the internal element and is in the form of rectilinear segments parallel to a second direction.

10. The capsule according to claim 9, wherein the signalling means comprises a second signal that is located on the upper portion of the internal element and is in the form of rectilinear segments parallel to a third direction, which is inclined relative to the second direction.

11. The capsule according to claim 5, wherein the top part (21) of the external cap (2) comprises a first plurality of lenses (211) of prismatic shape, located parallel to the main direction (A1), and a second plurality of lenses (212), of prismatic shape, located parallel to an auxiliary direction (A4), which is inclined relative to the main direction (A1).

12. The capsule according to claim 11, wherein the first plurality of lenses (211) is located on one side of the top part (21) and the second plurality of lenses (212) is located on the opposite side of the top part (21).

13. The capsule according to claim 11, wherein the top part (21) comprises at least a transparent portion (213) which is not occupied by the first plurality of lenses (211) and the second plurality of lenses (212).

14. The capsule according to claim 13, wherein: the signalling means (S) comprises a signal (74) located on an upper portion (31) of the internal element (3); the transparent portion (213) and the signal (74) are located so as to face each other in the intermediate opening position.

15. The capsule according to claim 1, wherein the top part (21) of the external cap (2) comprises a lens or a set of lenses conformed so as to bring an upper portion (31) of the internal element (3) into focus in the intermediate opening position.

* * * * *